US009840015B2

(12) United States Patent
King et al.

(10) Patent No.: US 9,840,015 B2
(45) Date of Patent: Dec. 12, 2017

(54) KNIFE ASSEMBLY WITH TAB BLADE

(71) Applicant: URSCHEL LABORATORIES, INC., Valparaiso, IN (US)

(72) Inventors: Daniel Wade King, Valparaiso, IN (US); Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 315 days.

(21) Appl. No.: 14/564,817

(22) Filed: Dec. 9, 2014

(65) Prior Publication Data

US 2015/0107426 A1 Apr. 23, 2015

Related U.S. Application Data

(63) Continuation-in-part of application No. 13/868,763, filed on Apr. 23, 2013.

(60) Provisional application No. 61/914,091, filed on Dec. 10, 2013, provisional application No. 61/636,769, filed on Apr. 23, 2012.

(51) Int. Cl.

| | |
|---|---|
| ***B26D 1/00*** | (2006.01) |
| ***B26D 3/28*** | (2006.01) |
| ***B26D 3/26*** | (2006.01) |
| ***B26D 1/03*** | (2006.01) |
| ***B26D 7/06*** | (2006.01) |

(52) U.S. Cl.

CPC ..... *B26D 1/0006* (2013.01); *B26D 1/03* (2013.01); *B26D 3/26* (2013.01); *B26D 7/0691* (2013.01); *B26D 2001/006* (2013.01); *B26D 2001/0033* (2013.01); *B26D 2003/288* (2013.01); *Y10T 83/0586* (2015.04); *Y10T 83/9457* (2015.04)

(58) Field of Classification Search

CPC . B26D 1/03; B26D 7/06; B26D 7/014; B26D 7/0691; B26D 3/26; B26D 1/006; B26D 2003/288; B26D 2001/006; B26D 3/283; B26D 2001/003; Y10T 83/6473; Y10T 83/9464; Y10T 83/9493; Y10T 83/6481; Y10T 83/9457; Y10T 83/0586

USPC ..... 83/53, 52, 403, 404.3, 698, 856, 404.1, 83/404.2, 865, 592, 932, 425.3, 857, 83/356.3, 408, 666, 698.11; 241/291, 241/291.1, 37.5, 199.12

See application file for complete search history.

(56) References Cited

U.S. PATENT DOCUMENTS 1,094,604 A * 4/1914 Shibata ..... B26D 3/18 83/395
1,430,289 A * 9/1922 Dahmer ..... A47J 43/25 30/279.6

(Continued)

OTHER PUBLICATIONS

European Extended Search Report dated Jul. 26, 2017.

*Primary Examiner* — Ghassem Alie
(74) *Attorney, Agent, or Firm* — Hartman Global IP Law; Gary M. Hartman; Domenica N. S. Hartman

(57) ABSTRACT

Knife assemblies and methods therefor that are adapted to be used with a cutting apparatus capable of producing a variety of shaped food products having large amplitudes, for example, sliced, shredded, and strip-cut food products. The knife assembly includes a primary blade having a corrugated shape to produce a large-amplitude food product slice having a periodic shape, and at least one tab blade assembled with or formed from the primary blade to cut a food product slice into strips.

5 Claims, 9 Drawing Sheets

(56) References Cited

U.S. PATENT DOCUMENTS

| | | | | | |
|---|---|---|---|---|---|
| 2,791,026 | A | * | 5/1957 | Byrd | B26B 3/03 30/115 |
| 2,884,974 | A | * | 5/1959 | Woodward, Jr. | B26D 3/18 83/403 |
| 3,139,130 | A | * | 6/1964 | Urschel | B26D 1/03 83/13 |
| 3,395,742 | A | * | 8/1968 | Sanders | B26D 1/0006 83/698.41 |
| 4,590,835 | A | * | 5/1986 | Matsuo | B26D 1/03 83/403 |
| 5,095,875 | A | | 3/1992 | Morris et al. | |
| 5,745,999 | A | | 5/1998 | Zirkiev | |
| 7,096,771 | B2 | | 8/2006 | Mendenhall | |
| 2010/0236372 | A1 | | 9/2010 | Desailly et al. | |
| 2013/0276604 | A1 | | 10/2013 | King et al. | |

* cited by examiner

KNIFE ASSEMBLY WITH TAB BLADE

CROSS REFERENCE TO RELATED APPLICATIONS

This is a continuation-in-part patent application of co-pending U.S. patent application Ser. No. 13/868,763, filed Apr. 23, 2013, which claimed the benefit of U.S. Provisional Application No. 61/636,769, filed Apr. 23, 2012. In addition, this application claims the benefit of U.S. Provisional Application No. 61/914,091, filed Dec. 10, 2013. The contents of these prior applications are incorporated herein by reference.

BACKGROUND OF THE INVENTION

The present invention generally relates to methods and equipment for cutting food products, and shapes of food products produced thereby.

Various pieces of equipment are used for slicing, shredding, and texturing food products such as vegetable, fruit, dairy, and meat products. Commonly used equipment used in this field are commercially available from Urschel Laboratories, Inc., under the name Urschel Model CC®, which are centrifugal-type cutting machines capable of producing uniform slices, strip cuts, shreds and granulations of a wide variety of food products at high production capacities. Model CC® machines generally comprise one or more knife assemblies arranged in sets spaced around the circumference of a cutting head.

Various types of knives have been developed for making specific types of cuts in food products, examples of which are knives developed to produce what is known as the julienne cut. Such a cut typically results in a food product, commonly a vegetable, being cut into long strips with rectangular or square cross sections. FIGS. 7 through 9 represent knives 50, 52 and 54 recently developed to produce julienne cuts with machines such as the aforementioned Urschel Model CC® machines. Each of the knives 50, 52 and 54 comprises a large-amplitude shaped (corrugated) blade 56 suitable for producing large-amplitude shaped food products, including shaped shredded and shaped strip-cut food products, non-limiting examples of which include those disclosed in U.S. Design Pat. Nos. D711068 and D704919. The profiles of these blades 56, when viewed from their leading edges 60, resemble a wave pattern, while secondary blades (tabs 58) are shown as located at the peaks 62 of these waves to produce a desired julienne cross section. In use, the leading edge 60 of the blade 56 cuts a slice off of a food product, followed by the julienne tabs 58 that cut the slice into strips.

The leading edges of the tabs 58 represented in FIG. 7 are located behind the leading edge 60 of the blade 56 and the tabs 58 extend to the trailing edge of the blade 56. Relatively narrow julienne tabs 58 are represented in FIG. 8, and relatively narrow staggered julienne tabs 58 are represented in FIG. 9. The tabs 58 of FIG. 7 are also represented as each having a height from a surface of the blade 56 to the outermost extent of the julienne tab 58 that is a maximum in proximity to the leading edge 60 of the blade 56 (corresponding to the leading edge of the tab 58) and continuously tapers to a minimum at or adjacent the trailing edge of the blade 56 (corresponding to the trailing edge of the tab 58). It will be appreciated that the tabs 58 of FIGS. 7 through 9 may be modified to have any shape or size suitable for cutting the food product slices into strips. While shown as located only on the peaks 62, it is foreseeable that tabs 58 could be additionally or alternatively located in the valleys 64 of the blades 56.

An advantageous aspect of the knives 50, 52 and 54 of FIGS. 7, 8 and 9 is the avoidance of the prior art practice of using a knife assembly comprising a shaped blade and a separate julienne knife. The tabs 58 can be metallurgically joined to the blade 56 by any means known in the art, for example, brazing and/or welding, for example, laser welding. The wider julienne tabs 58 represented in FIG. 7 are believed to be more securely attachable to the blade 56 than are narrower tabs 58 of the types represented in FIGS. 8 and 9, as more surface area of each wider tab 58 is secured to the blade 56 relative to the narrower tabs 58. However, wider tabs 58 may exert excessive forces on the food product slices. It is believed that, as a slice is produced by the blade 56, the slice deforms around the thickness of individual tabs 58, creating pressure on the slice between adjacent tabs 58. If the pressure between the tabs 58 is too great, the now-separated slice could slow and potentially stop before the julienne slices are complete. For this reason, the julienne tabs 58 are preferably constructed of the thinnest material possible while maintaining structural rigidity. Because the tabs 58 of sequential blades 56 are also sequential, it may be desirable to narrow (as in FIG. 8) and/or stagger (as in FIG. 9) the tabs 58, that is, at differing distances from the leading edge of the blade 56, to minimize the pressure between adjacent tabs 58.

While well suited for the intended purpose, it would be desirable if alternative configurations for knives of the types described above were available for producing julienne cuts in food products.

BRIEF DESCRIPTION OF THE INVENTION

The present invention provides knife assemblies of types suitable for producing julienne cuts in food products, including cuts of types that can be produced with the knives 50, 52, 54 and FIGS. 7, 8 and 9. The knife assemblies include a primary blade with at least one tab blade that is assembled with or formed from the primary blade without the need to fuse the primary and tab blades together.

According to an aspect of the invention, a knife assembly adapted for producing julienne cut food product includes a primary blade having a corrugated shape to produce a large-amplitude food product. The corrugated shape has a cutting leading edge and defining multiple peaks and valleys. The primary blade further has slots located at least some of the peaks. The knife assembly includes at least one tab blade adapted to cut the large-amplitude food product slice into strips. The tab blade has a cross-sectional shape comprising a lower section that is complementary to a valley of the primary blade and comprising at least two bladed sections adapted to extend through at least two of the slots of the primary blade so as to be exposed above at least two peaks of the primary blade. The primary and tab blades are not metallurgically joined together.

According to another aspect of the invention, a method of producing julienne cut food products includes installing at least two sequential knife assemblies on a cutting apparatus. Each of the knife assemblies have a primary blade having a corrugated shape to produce a large-amplitude food product and at least one tab blade adapted to cut the large-amplitude food product slice into strips. The corrugated shape of the primary blade defines multiple peaks and valleys. The primary blade further has slots located at least some of the peaks. The tab blade has a cross-sectional shape comprising a lower section that is complementary to a valley of the primary blade and includes at least two bladed sections that extend through at least two of the slots of the primary blade so as to be exposed above at least two peaks of the primary blade. The primary and tab blades are not metallurgically joined together. The method includes operating the cutting apparatus to produce shaped shredded or shaped strip-cut food products.

According to another aspect of the invention, a knife assembly adapted for producing julienne cut food product includes a primary blade having a corrugated shape to produce a large-amplitude food product. The corrugated shape has a cutting leading edge and defines multiple peaks and valleys. The knife assembly includes at least one tab blade adapted to cut the large-amplitude food product slice into strips. The tab blade is defined by a cut in the primary blade that forms a tab and then bending the tab so that the tab protrudes from the primary blade.

According to another aspect of the invention, a method of producing julienne cut food products includes installing at least two sequential knife assemblies on a cutting apparatus. Each of the knife assemblies include a primary blade having a corrugated shape to produce a large-amplitude food product and at least one tab blade adapted to cut the large-amplitude food product slice into strips. The corrugated shape of the primary blade has a cutting leading edge and defines multiple peaks and valleys. The tab blade is an extension of the primary blade produced by a cut section of the primary blade that is bent to protrude from the primary blade. The method includes operating the cutting apparatus to produce shaped shredded or shaped strip-cut food products.

A technical effect of the invention is the ability produce to julienne cuts in food products without the need to fuse the primary and tab blades together or to assemble multiple blades.

Other aspects and advantages of this invention will be better appreciated from the following detailed description.

DETAILED DESCRIPTION OF THE INVENTION

Figure 6:
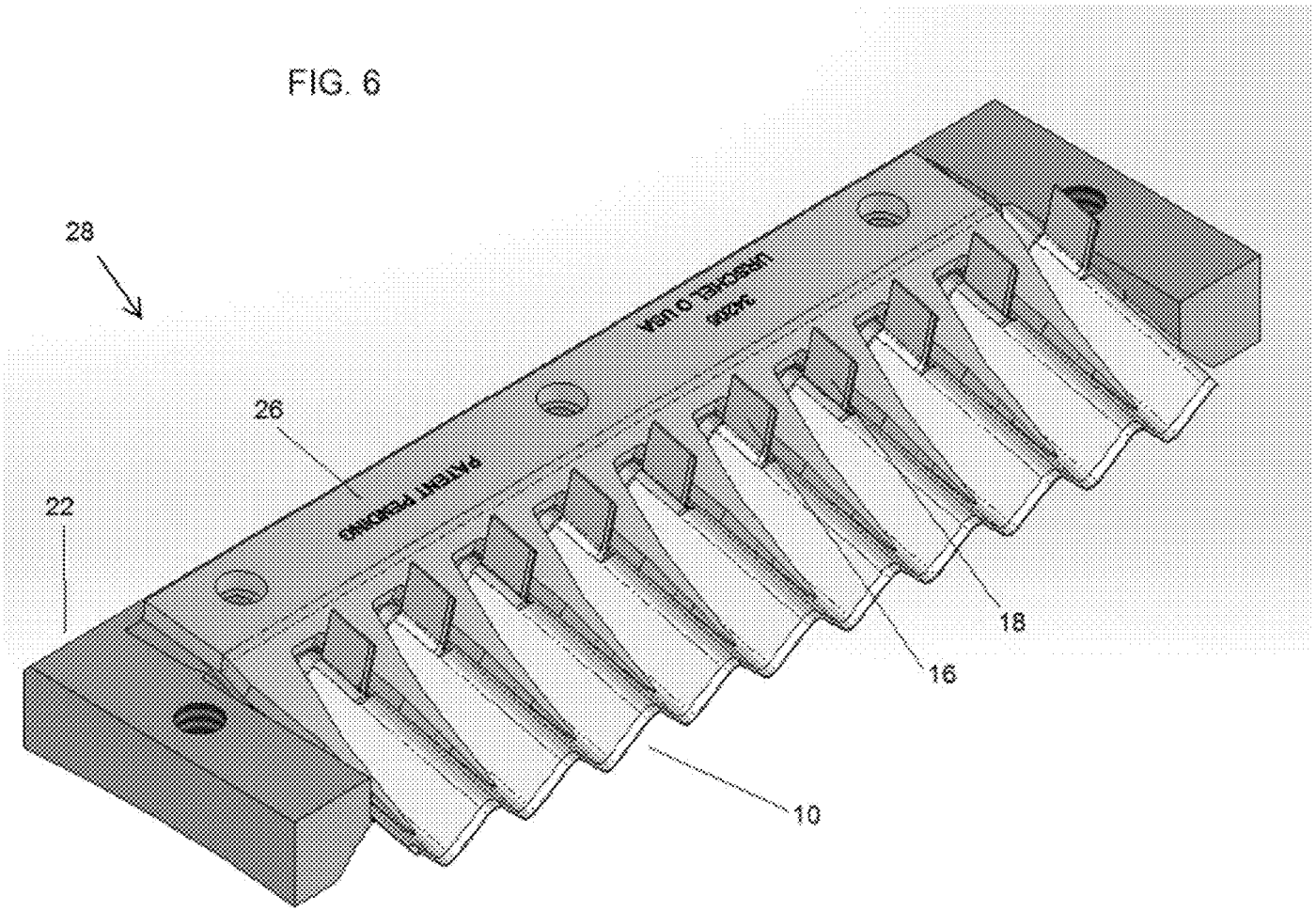
FIG. 6 is a perspective view showing the knife holder of FIG. 5 further assembled with a clamp.
Figure 7:
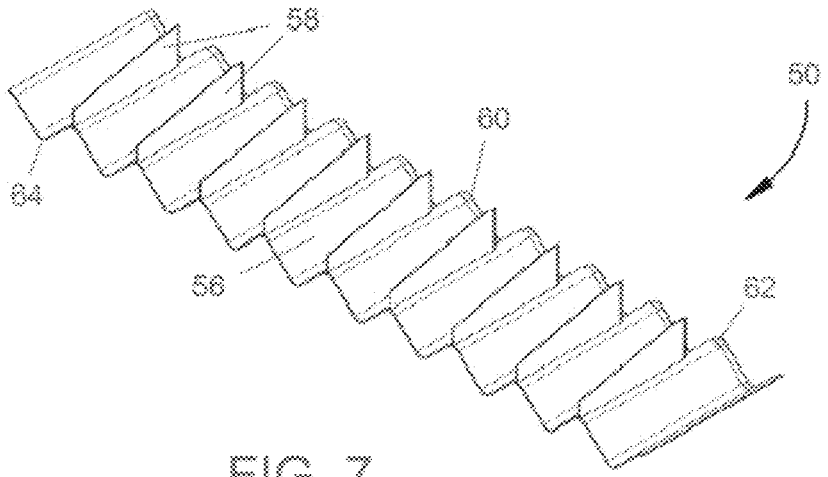
FIGS. 7 through 9 are perspective views representing shaped knives for producing large-amplitude shaped food products, including shaped shredded and shaped strip-cut food products.
Figure 8:
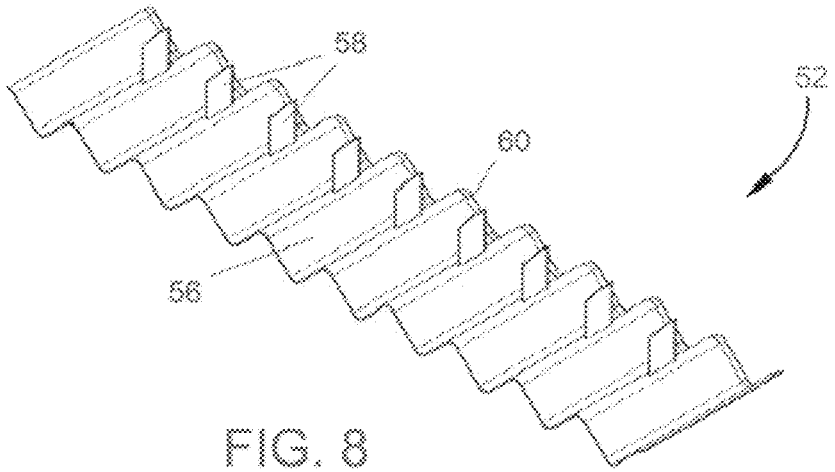
Figure 9:
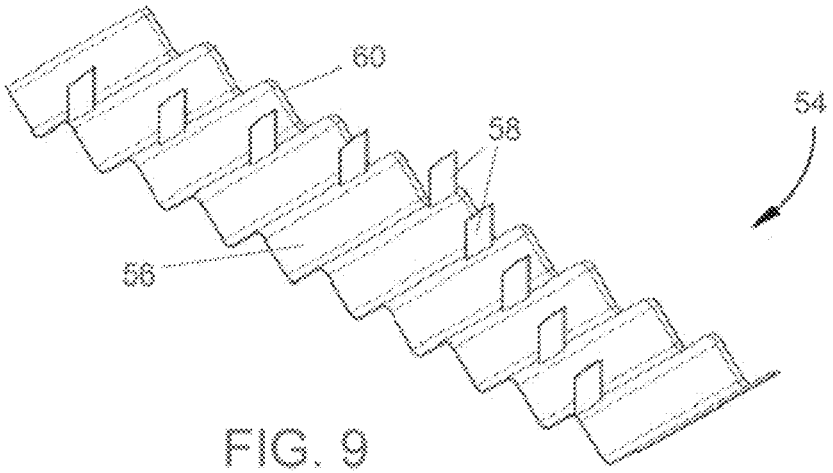

FIG. 6 represents a knife assembly 28 of a type suitable for producing julienne cuts in food products, including cuts similar to the types that can be produced with the knives 50, 52, 54 of FIGS. 7, 8 and 9. The assembly 28 is particularly well suited for use in centrifugal-type cutting apparatuses, for example, the Model CC®, to produce uniform cuts in bulk quantities of food products. The assembly 28 includes a primary blade 10 having a profile that, when viewed from its leading edge, resembles a wave pattern to produce large-amplitude shaped food products. The assembly 28 further includes secondary "tab" blades 16 with bladed sections 18 (see FIG. 2) located at peaks of the primary blade 10 to enable the assembly 28 to produce shaped shredded and shaped strip-cut food products. The assembly 28 also includes a knife holder 22 and a clamp 26 to keep the various components in place.

Figure 1:
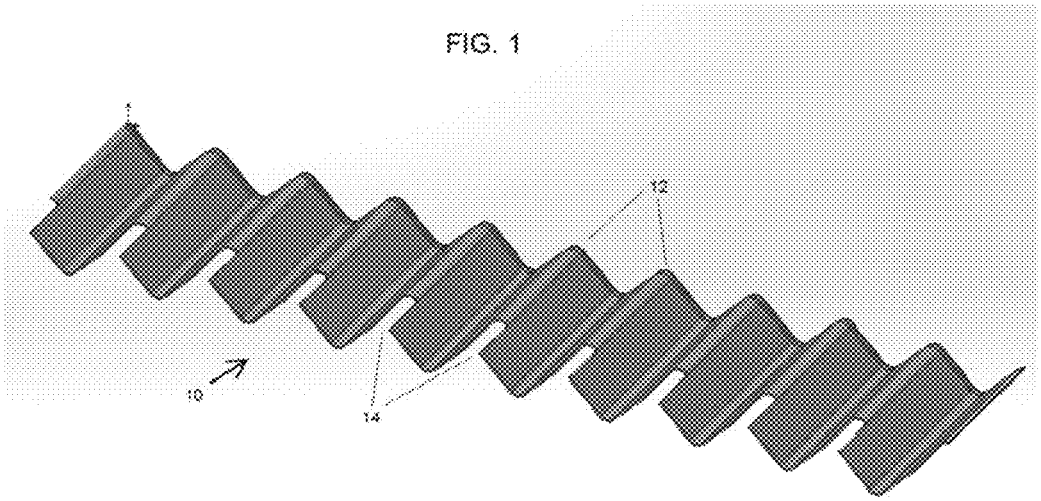
FIG. 1 is a perspective view of a primary blade with tab slots adapted to receive tab blades for producing large-amplitude shaped food products, including shaped shredded and shaped strip-cut food products.
Figure 2:
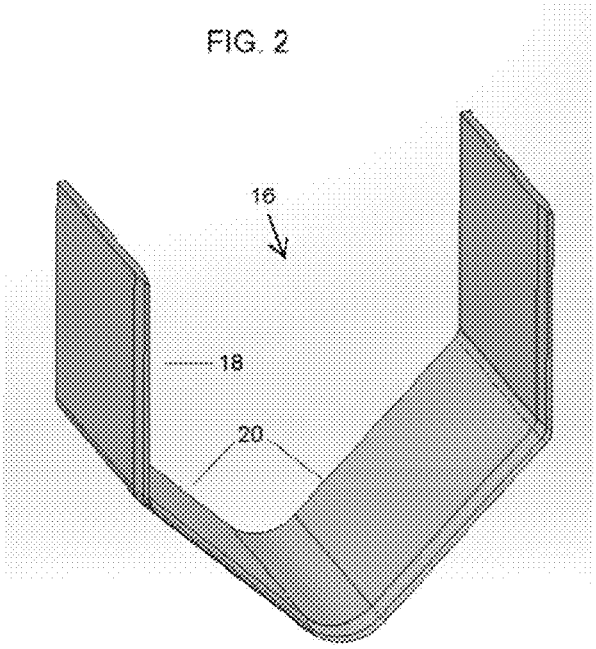
FIG. 2 is a perspective view of a tab blade adapted for assembly with the primary blade of FIG. 1.

Referring to FIG. 1, the primary blade 10 is equipped with tab slots 14 located at peaks 12 of its wave form, and through which the bladed sections 18 of the tab blades 16 extend and are aligned with the primary blade 10 without the need to metallurgically join the two components together. FIG. 2 illustrates a nonlimiting embodiment of an individual tab blade 16 having two bladed sections 18 interconnected by a lower section 20 to yield a roughly U-shaped or V-shaped cross-section. The shapes of the primary and tab blades 10 and 16 are complementary to enable the tab blade 16 to be placed beneath a valley of the primary blade 10 so that the two bladed sections 18 of the tab blade 16 individually extend up through two adjacent tab slots 14 of the blade 10.

Figure 3:
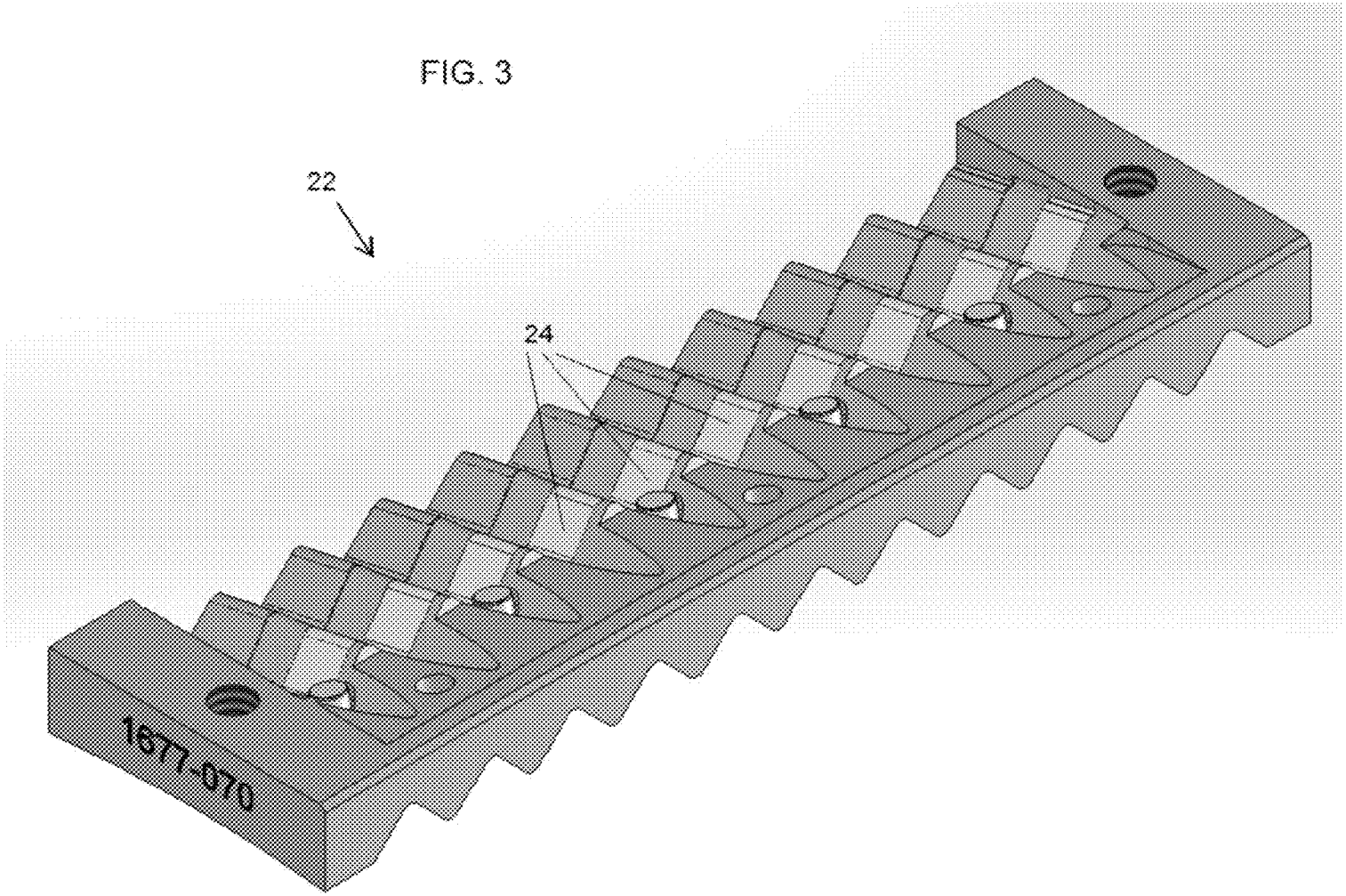
FIG. 3 is a perspective view of a knife holder for a knife assembly comprising the primary and tab blades of FIGS. 1 and 2.

FIG. 3 is an isolated view of the knife holder 22, which serves as the foundation of the knife assembly 28. The knife holder 22 is similar to conventional knife holders of types used with the Model CC®, at least to the extent that the knife holder 22 is fabricated to have a surface contour with peaks and valleys complementary to the peaks and valleys of the primary blade 10, such that the blade 10 can be assembled with the holder 22 by placing the blade 10 on the holder 22 so that the peaks and valleys of its contour coincide with the peaks and valleys of the contour of the knife holder 22. For use with the present invention, the knife holder 22 has been modified to include relief areas 24 within valleys of the holder 22. The relief areas 24 are shaped and sized to accommodate the lower sections 20 of the tab blades 16, which are located between the knife holder 22 and the primary blade 10 in the assembly 28 of FIG. 6.

Figure 4:
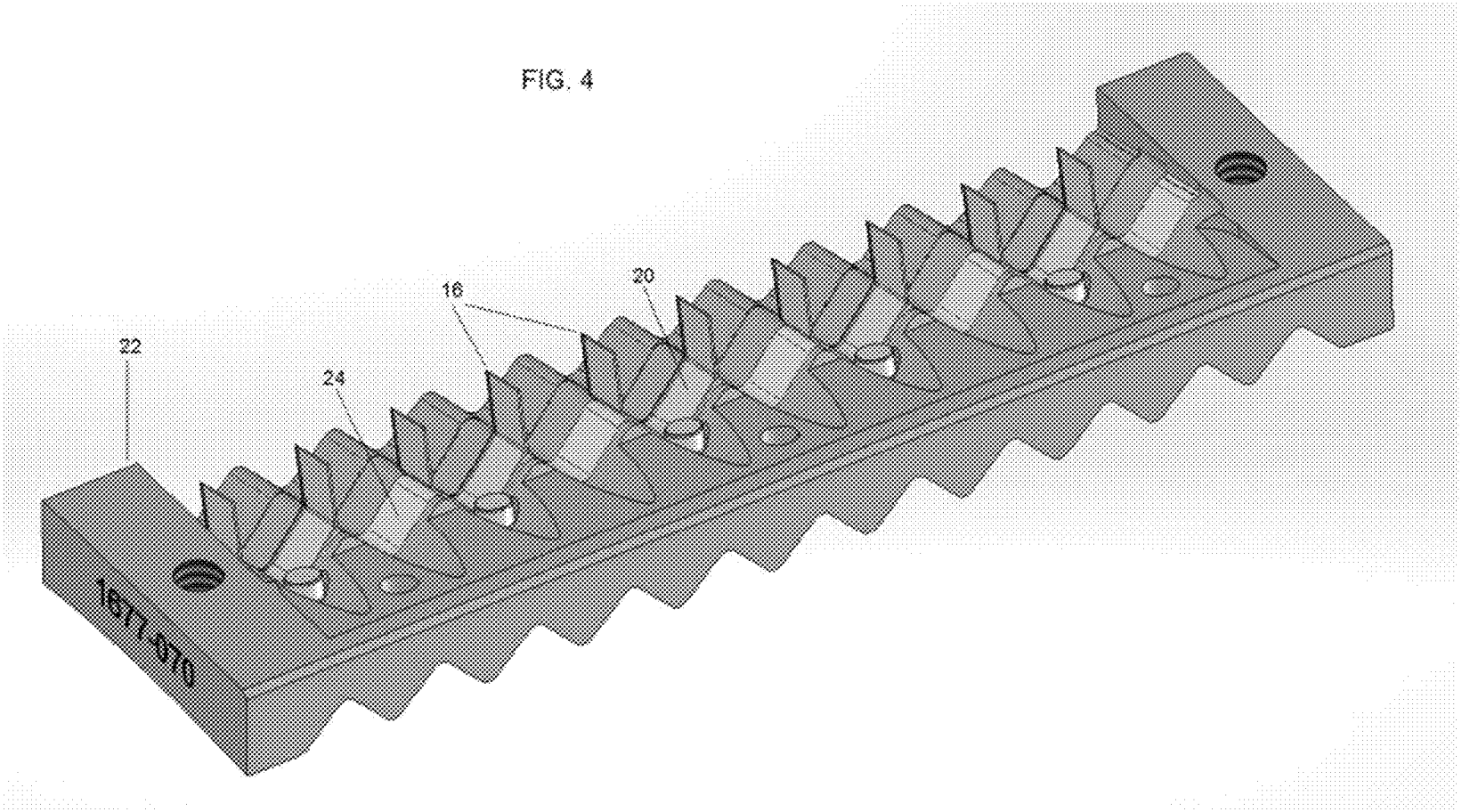
FIG. 4 is a perspective view showing the tab blades of FIG. 2 assembled with the knife holder of FIG. 3.

FIG. 4 shows the knife holder 22 with the tab blades 16 appropriately placed in the relief areas 24 of the knife holder 22. The lower section 20 of each tab blade 16 is completely received in one of the relief areas 24 of the knife holder 22, while the bladed sections 18 of each tab blade 16 extend away from the surface of the holder 22. The relief areas 24 allow the knife holder 22 and the tab blades 16 in combination to define a contour that is complementary to the contour of the primary blade 10.

Figure 5:
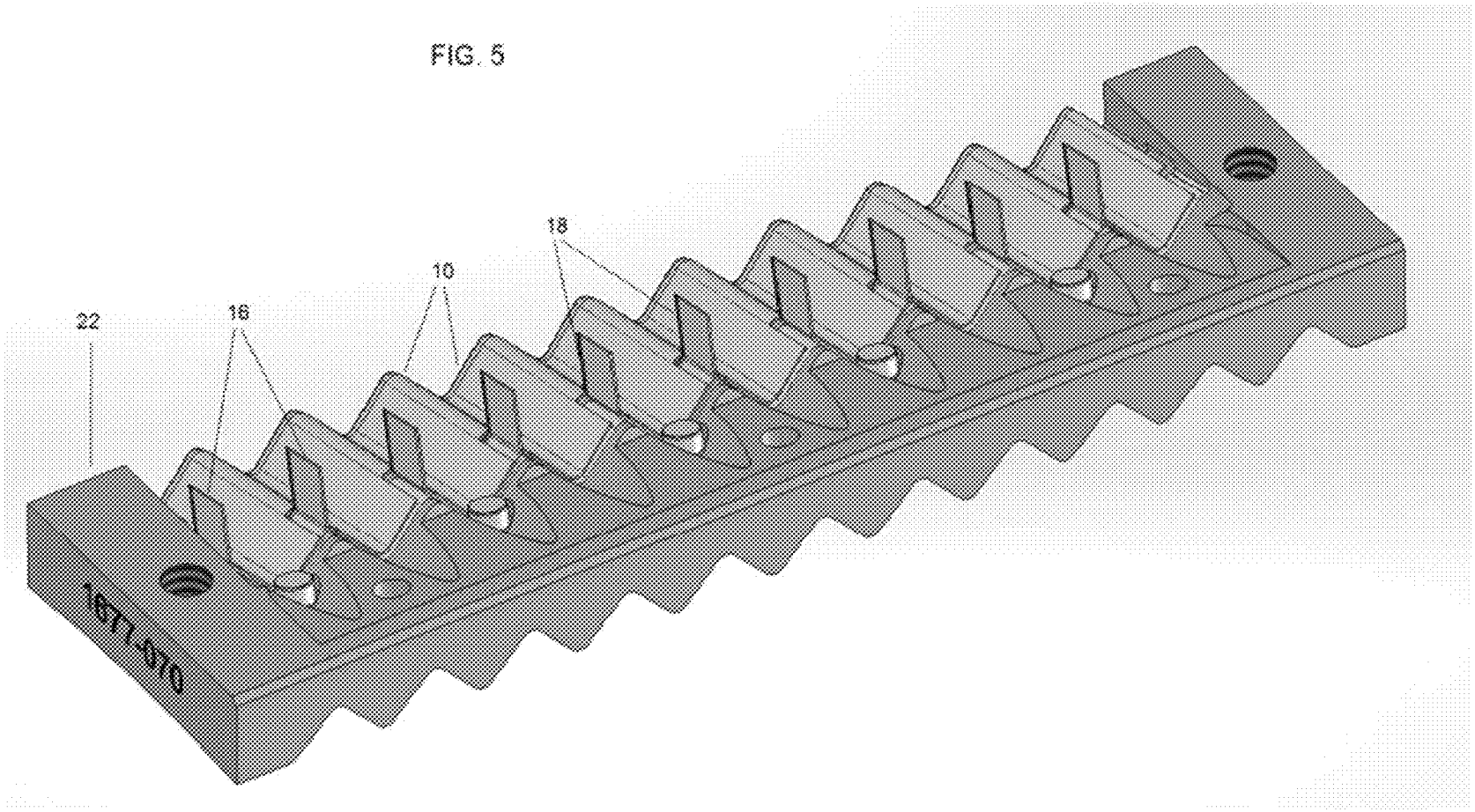
FIG. 5 is a perspective view showing the knife holder of FIG. 4 further assembled with the primary blade of FIG. 1.

FIG. 5 shows the primary blade 10 placed on the subassembly of FIG. 4. The bladed sections 18 of the tab blades 16 remain exposed as a result of extending through the slots 14 in the blade 10. As previously noted, FIG. 6 shows the completed knife assembly 28 following placement of the clamp 26 on the subassembly of FIG. 5.

The finished knife assembly 28 is capable of providing uniform julienne cuts, similar or identical to cuts produced by the knife assemblies 50, 52 and 54. However, the knife assembly 28 avoids the need to metallurgically join the tab blades 16 to the primary blade 10. Instead, the primary and tab blades 10 and 16 are secured together solely by the clamp 26 and the manner in which the blades 10 and 16 and the holder 22 are nested together as a result of their complementary contours.

Figure 10:
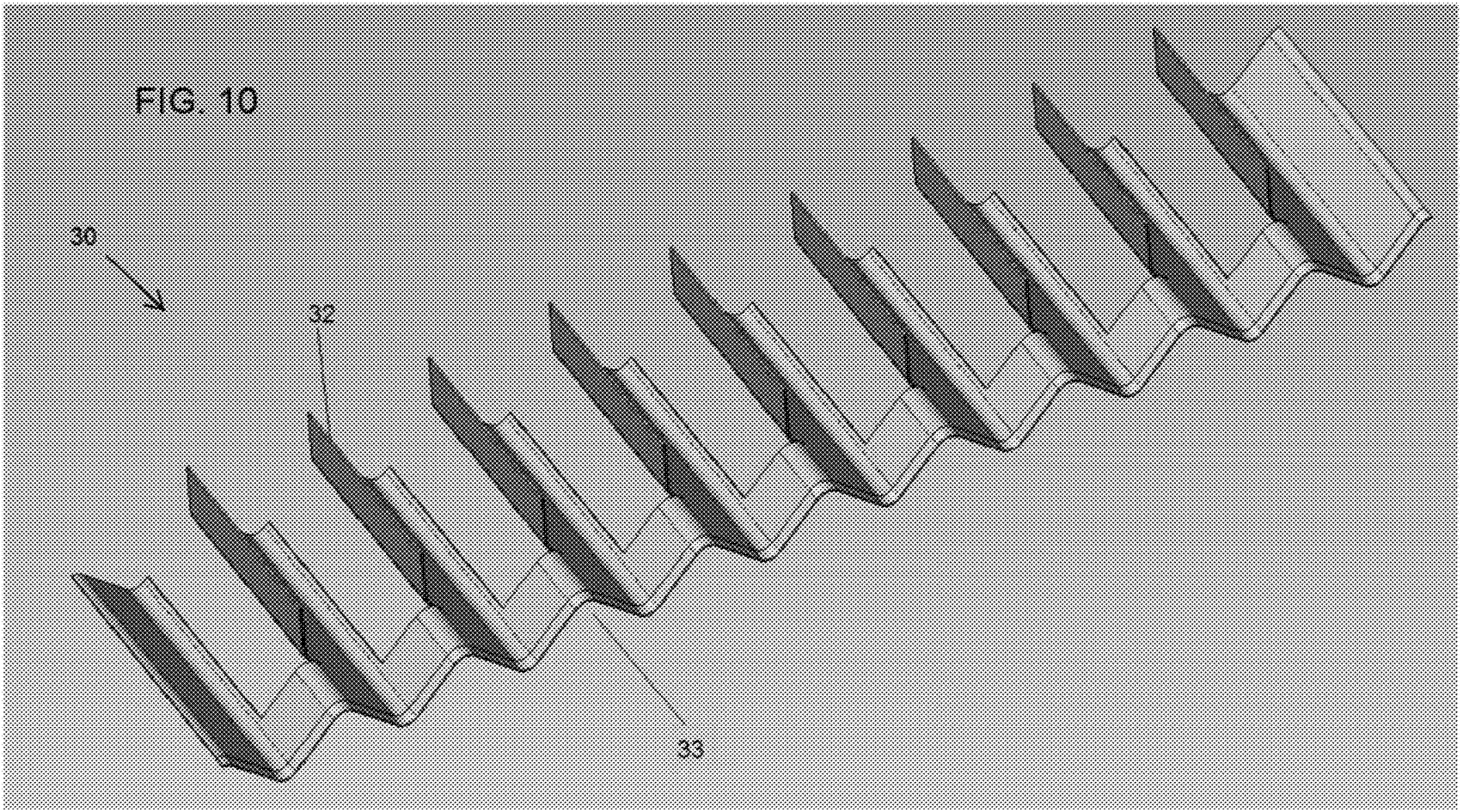
FIGS. 10 and 11 are perspective views of an embodiment in which a primary blade has tab blades integrally formed therefrom in accordance with aspects of the invention.
Figure 11:
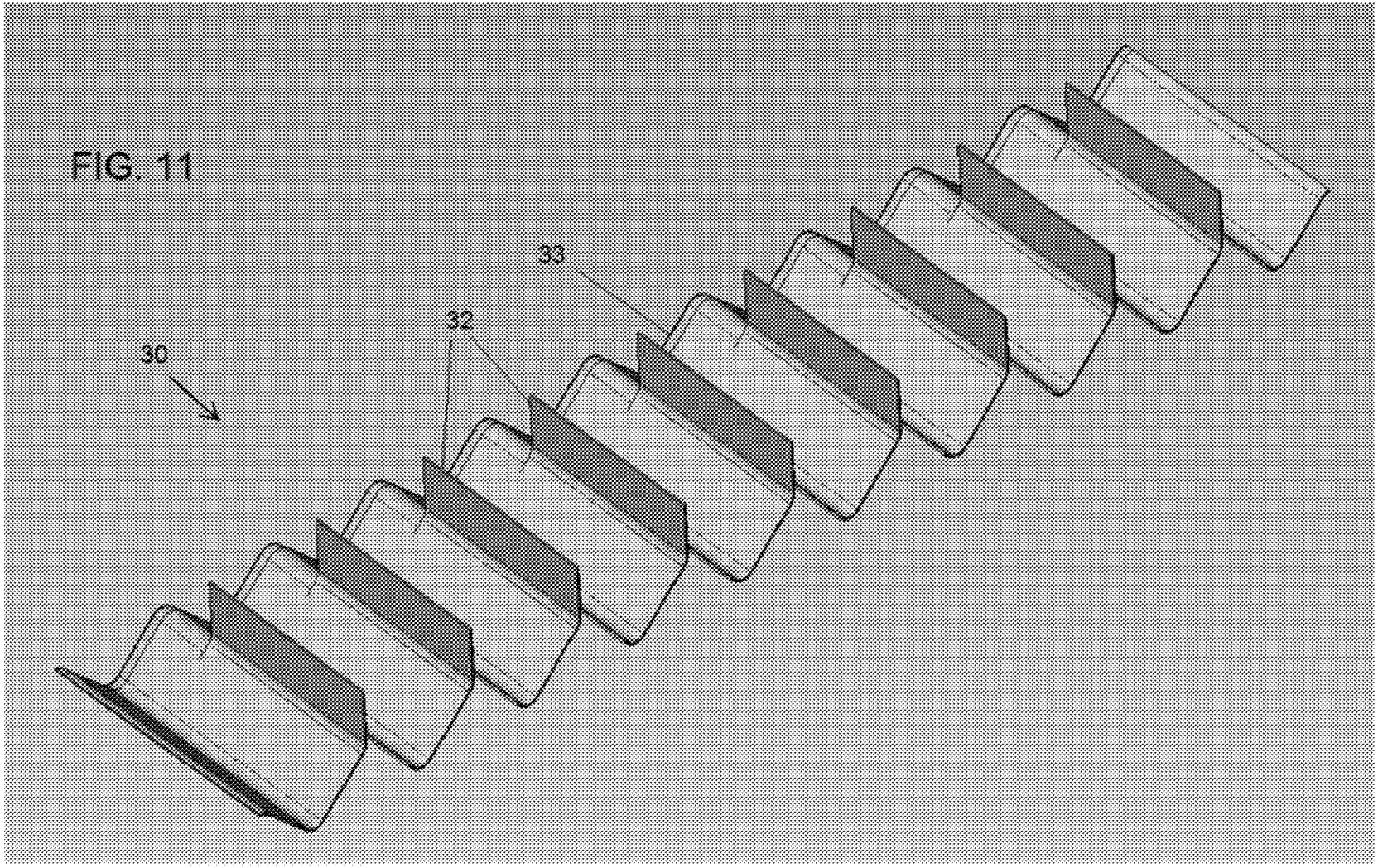

Another possible embodiment of the invention is shown in FIGS. 10 and 11. In this embodiment, a blade 30 that defines a primary leading edge 33 is modified to provide tab blades 32 without requiring welding or assembling the tab blades 32 with the blade 30 or other structure adapted to define the primary leading edge 33. Each tab blade 32 is individually formed by making two contiguous cuts in the blade 30, a first of which starts at the trailing edge of the blade 30 within or adjacent a valley of the blade 30 and continues toward but short of the leading edge 33 of the blade 30. The second cut extends from the valley toward an adjacent peak, such that the second cut is set back a distance from the leading edge 33. The resulting tab is then bent upright at the peak where it remains attached to the blade 30, as evident in FIGS. 10 and 11. The tab blades 32 are functionally equivalent to the bladed sections 18 of the tab blades 16 of FIGS. 1-6, in that the tab blades 32 are located at peaks of the blade 30 to produce shaped shredded and shaped strip-cut food products. As with the tab blades 16 of FIGS. 1-6, the tab blades 32 of FIGS. 10 and 11 could be located within the valleys of the blade 30. The tab blades 32 can be created to have square leading edges, for example, by cutting with a die or three-axis laser, or created to have beveled or angled leading edges, for example, using a laser with additional axes of rotation or a wire EDM. As with the assembly 28 of FIG. 6, the blade 30 can be used in combination with a knife holder 22 and a clamp 26 to secure the blade 30. The first cuts may be configured to have varying lengths such that the tabs blades 32 of sequential peaks are staggered (as in FIG. 9), that is, at differing distances from the leading edge 33 of the blade 30, to minimize the pressure between adjacent tab blades 32.

Figure 12:
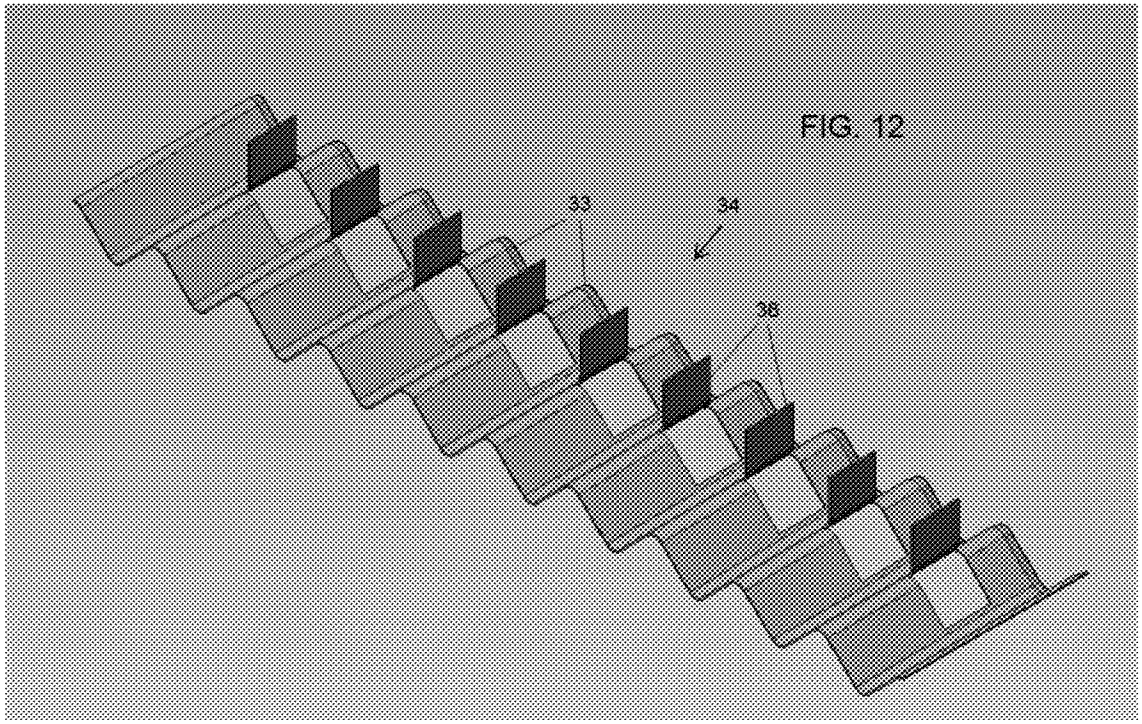
FIG. 12 is a perspective view of another embodiment in which a primary blade has tab blades integrally formed therefrom in accordance with aspects of the invention.

A further possible embodiment of the invention is shown in FIG. 12. This embodiment is similar to the embodiment shown in FIGS. 10 and 11, with the primary exception that the tab blades 36 do not entirely extend to the trailing edge of the blade 34. As such, this embodiment requires at least a third contiguous cut that extends from the valley toward the adjacent peak, with the third cut spaced a distance from the trailing edge of the blade 34. Methods of producing the blade 34 can be the same as those mentioned for the previous embodiment.

While the invention has been described in terms of specific embodiments, it is apparent that other forms could be adopted by one skilled in the art. For example, the knife assemblies and the apparatus in which they are installed could differ in appearance and construction from the knife assemblies and cutting heads shown in the drawings, and materials and processes other than those noted could be used. Therefore, the scope of the invention is to be limited only by the following claims.

The invention claimed is:

1. A knife assembly adapted for producing julienne cut food product, the knife assembly comprising:

a primary blade having a corrugated shape to produce a large-amplitude food product, the corrugated shape having a cutting leading edge and defining multiple peaks and valleys; and at least one tab blade adapted to cut the large-amplitude food product slice into strips, the tab blade being defined by a cut in the primary blade that forms a tab and then bending the tab so that the tab protrudes from the primary blade, the tab blade being integral with the primary blade;

wherein the cut that defines the tab blade comprises a first cut along a first of the valleys of the primary blade and a second cut between the first valley and an adjacent peak of the primary blade, the tab blade protruding from the primary blade at a location adjacent the adjacent peak.

2. The knife assembly of claim 1, wherein the knife assembly is adapted to produce shaped shredded or shaped strip-cut food products.

3. The knife assembly of claim 1, wherein the first cut is continuous through a trailing edge of the primary blade oppositely disposed from the leading edge of the primary blade.

4. The knife assembly of claim 1, wherein the first cut does not extend to a trailing edge of the primary blade oppositely disposed from the leading edge of the primary blade.

5. The knife assembly according to claim 1, wherein the tab blade has a square leading edge.

* * * * *